US005690393A

United States Patent [19]

Massa et al.

[11] Patent Number: 5,690,393

[45] Date of Patent: Nov. 25, 1997

[54] CUTTING TOOL RETENTION SYSTEM

[75] Inventors: Ted R. Massa, Latrobe; Robert H. Montgomery, Jr., Everett, both of Pa.

[73] Assignee: Kennametal Inc., Latrobe, Pa.

[21] Appl. No.: 641,608

[22] Filed: May 1, 1996

[51] Int. Cl.[6] ..... E21C 35/197

[52] U.S. Cl. ..... 299/107; 37/458

[58] Field of Search ..... 299/107, 109; 37/458, 459

[56] References Cited

U.S. PATENT DOCUMENTS

| | | | |
|---|---|---|---|
| 3,268,260 | 8/1966 | Snipe | 299/107 |
| 3,342,531 | 9/1967 | Krekeler | 299/107 |
| 3,499,685 | 3/1970 | Kniff | 299/104 |
| 3,512,838 | 5/1970 | Kniff | 299/104 |
| 3,519,309 | 7/1970 | Engle et al. | 299/107 |
| 3,650,565 | 3/1972 | Kniff | 299/106 |
| 3,752,515 | 8/1973 | Oaks et al. | 403/344 |
| 3,820,848 | 6/1974 | Kniff | 299/107 |
| 3,826,024 | 7/1974 | Peterson | 37/458 |
| 4,299,424 | 11/1981 | LeBegue et al. | 299/103 |
| 4,337,980 | 7/1982 | Krekeler | 299/102 |
| 4,505,058 | 3/1985 | Peterson | 37/459 |
| 4,575,156 | 3/1986 | Hunter et al. | 299/107 |
| 4,850,649 | 7/1989 | Beach et al. | 299/107 |
| 4,859,543 | 8/1989 | Greenfield et al. | 428/552 |
| 4,886,710 | 12/1989 | Greenfield | 428/564 |
| 4,952,001 | 8/1990 | Emmerich | 299/107 |
| 5,007,685 | 4/1991 | Beach et al. | 299/85.2 |
| 5,067,775 | 11/1991 | D'Angelo | 299/104 |
| 5,088,797 | 2/1992 | O'Neill | 299/104 |
| 5,261,499 | 11/1993 | Grubb | 175/107 |
| 5,374,111 | 12/1994 | Den Besten et al. | 299/106 |
| 5,529,384 | 6/1996 | Ojanen et al. | 299/107 |

FOREIGN PATENT DOCUMENTS

| | | | |
|---|---|---|---|
| 1242609 | 7/1986 | U.S.S.R. | 299/109 |

*Primary Examiner*—David J. Bagnell
*Attorney, Agent, or Firm*—John J. Prizzi

[57] ABSTRACT

A cutting tool retention system for retaining a cutting tool having a tool recess. The cutting tool retention system comprises a support block having a block bore and a block recess intersecting the block bore and a clip movably situated in the block recess, the clip having a spring structure which engages the support block and urges the clip into an engaging relationship with the tool recess of the cutting tool situated within the block bore, the spring structure allowing the clip to be disengaged from an engaging relationship with the tool recess of the cutting tool situated within the block bore by applying force directly to the clip so as to overcome the urging of the spring structure.

27 Claims, 2 Drawing Sheets

CUTTING TOOL RETENTION SYSTEM

TECHNICAL FIELD

This invention relates to cutting tools, and more particularly to a retention system for retaining such tools in a support block during use.

BACKGROUND ART

Cutting tool assemblies for such applications as mining or road milling typically comprise a cutting tool, sometimes called a cutting bit, rotatably mounted within a support block. The support block in turn is mounted onto a drum or other body, typically by welding, which in turn is driven by a suitable drive mechanism. When a number of such support blocks carrying cutting tools are mounted onto a drum, and the drum is driven, the cutting tools will engage and break up the material sought to be mined or removed. The general operation of such a mining or road milling machine is well known in the art.

Various methods have been proposed or used in the past to mount a cutting tool, rotatably or otherwise, within a support block.

For example, U.S. Pat. No. 3,519,309 to Engle et al. discloses a cutting tool retained by a captive keeper ring within a support block. More specifically, and as illustrated in FIGS. 10, 11 and 12 of the Engle et al. patent, the cutting tool has a cylindrical shank which defines an annular shank groove adapted for receiving resilient keeper member. The keeper member as shown comprises a split keeper ring made of, for example, spring steel and has a plurality of projections distributed around its perimeter. The support block has a main bore for receiving the shank of the cutting tool. The main bore of the support block is provided with an annular block groove for receiving the projections of the keeper ring when the shank of the cutting tool is forcibly pushed into the main bore of the support block. Such a retention method is generally known and used in the art.

The cutting tool retention method disclosed in the Engle et al. patent requires that force must be applied to the cutting tool as the cutting tool shank is inserted into the main bore of the block. Force is required to compress the resilient keeper member within the main bore of the support block until it expands into and engages the annular block groove. A similar force in the opposite direction must be used to remove the cutting tool from the main bore of the block and if such a force is applied to the tool during operation the cutting tool would be accidentally dislodged. This retention method also requires that the cutting tool, the most often replaced component of a cutting tool assembly, include a separate resilient keeper member component which complicates the manufacture of such cutting tools and increases the cost.

As another example, U.S. Pat. No. 3,268,260 to Snipe discloses a cutting tool retained by a U-shaped locking member within a mounting box or block. More specifically, and as illustrated in FIGS. 1–6 of the Snipe patent, the cutting tool has a cylindrical shank which defines a circumferential groove. The block defines a tool bore and two diverging holes which partially intersect the tool bore such that the diverging holes are exposed over one-half of their diameter on opposite sides of the tool bore. The U-shaped locking member has two limbs extending from a base. The locking member is used by hammering the base such that the limbs are forced to follow the diverging holes with about one-half of the limb diameters projecting into the tool bore and engaging the groove of the cutting tool inserted into the tool bore. The U-shaped locking member, which is held in place by the spread apart limbs, may be removed by inserting a pinch bar under the bore and prying the locking member limbs out of the two holes. The cutting tool may then be removed from the tool bore.

The cutting tool retention apparatus disclosed in the Snipe patent requires the U-shaped locking member to be physically manipulated and aligned properly before being forced into the two holes in order to engage the circumferential groove of the cutting tool shank inserted into the tool bore. Force is then required again to pry the U-shaped member from the two holes in order to disengage and remove the cutting tool from the tool bore. This retention method also places the U-shaped locking member under a constant bending stress when forced into the two holes to engage the cutting tool groove.

SUMMARY OF THE INVENTION

An object of the present invention is to provide an improved cutting tool retention system having a relatively simple mechanism. Another object of this invention is to provide a cutting tool retention system which allows a cutting tool to be rotatably or non-rotatably but detachably retained within a support block and which also allows the retention mechanism to be easily disengaged by a user to allow easy removal of the cutting tool.

The improved cutting tool retention system of this invention comprises a support block having a block bore and a block recess intersecting the block bore together with a clip movably situated in the block recess. The clip has a spring structure which engages the support block and urges the clip into an engaging relationship with the tool recess of the cutting tool situated within the block bore. The spring structure also allows the clip to be disengaged from an engaging relationship with the tool recess of the cutting tool situated within the block bore by a user applying force directly to the clip so as to overcome the urging of the spring structure.

In a preferred embodiment, the block recess of the support block has a clip spreader and the spring structure is a clip leg which engages the clip spreader and urges the clip into an engaging relationship with the tool recess of the cutting tool situated within the block bore. The clip leg allows the clip to be disengaged from an engaging relationship with the tool recess of the cutting tool situated within the block bore by a user applying force directly to and moving the clip such that the clip leg is displaced by the clip spreader.

The block recess may also include a clip saddle which engages the clip and limits movement of the clip when a user applies force to the clip so as to overcome the urging of the spring structure. Additionally, the clip operator end may define a clip seat configured to substantially mate with the clip saddle.

The clip leg may also have a clip retainer projection which is urged by the clip spreader into an engaging relationship with the tool recess of the cutting tool situated within the block bore. The clip retainer projection may also serve to prevent the clip from being removed from the block recess unless the cutting tool is no longer positioned in the block bore so as to be situated within the block recess.

Furthermore, the clip may have a clip operator end and at least two clip legs extending from the clip operator end, the at least two clip legs being the spring structure and flanking the clip saddle, the block bore, and the clip spreader. The at least two clip legs are displaced by the clip spreader when the user applies force directly to and moves the clip so as to disengage the clip from the tool recess of the cutting tool situated within the block bore.

The clip legs may have retainer projections, and the clip operator end, the clip legs and retainer projections may partially encircle the clip saddle and the block bore so as to prevent the clip from being dislodged from residing within the block recess when the cutting tool is situated within the block bore.

The improved cutting tool retention system of this invention also comprises a method for retaining a cutting tool having a tool recess in a support block having a block bore and a block recess by using a clip and a spring structure. The method comprises situating the clip in a block recess such that the clip protrudes into the block bore. Force is then applied to the clip such that the clip no longer protrudes into the block bore and the spring structure is activated. The cutting tool is inserted within the block bore such that the tool recess is located adjacent the block recess. The clip is then released such that the spring structure forces the clip to protrude into the block bore and into an engaging relationship with the tool recess.

Alternatively, the improved cutting tool retention system of this invention comprises a method for retaining a cutting tool having a tool recess in a support block having a block bore and a block recess intersecting the block bore. A clip having a spring structure is then movably situated in the block recess such that the clip will be urged by the spring structure to protrude into the block bore and engage the tool recess of the cutting tool inserted into the block bore unless a force is applied directly to the clip so as to overcome the urging of the spring structure.

In all of these embodiments, the tool recess of the cutting tool may be one or more notches or an annular groove, and the block bore of the support block may be surrounded by a seating shoulder region such that the tool shoulder will be in a contacting relationship with the seating shoulder region and the annular groove will be exposed within the block recess when the cutting tool is situated within the block bore.

An advantage of this invention is that because the clip is reusable with a number of different cutting tools, no resilient keeper member or other type of clip need be supplied when the cutting tool is used. Another advantage is that cutting tools may be inserted into, or withdrawn from, the block bore without any additional force necessary to compress a resilient keeper member or any other similar type clip. Another advantage is that cutting tools may be inserted into, or withdrawn from, the block bore without removing the clip from the block recess. Furthermore, the clip is not under any bending stresses when retaining the cutting tool. Lastly, another advantage of this invention is that if the clip is damaged or suffers excessive wear, it can be easily replaced by an operator on site without any tools and without excessive force required.

Further objects and advantages of this invention will be apparent from the following description, reference being had to the accompanying drawings wherein various embodiments of the present invention are clearly shown.

BRIEF DESCRIPTION OF THE DRAWINGS

While various embodiments of the invention are illustrated, the particular embodiments shown should not be construed to limit the claims. It is anticipated that various changes and modifications may be made without departing from the scope of this invention.

BEST MODE FOR CARRYING OUT THE INVENTION

Figure 1:
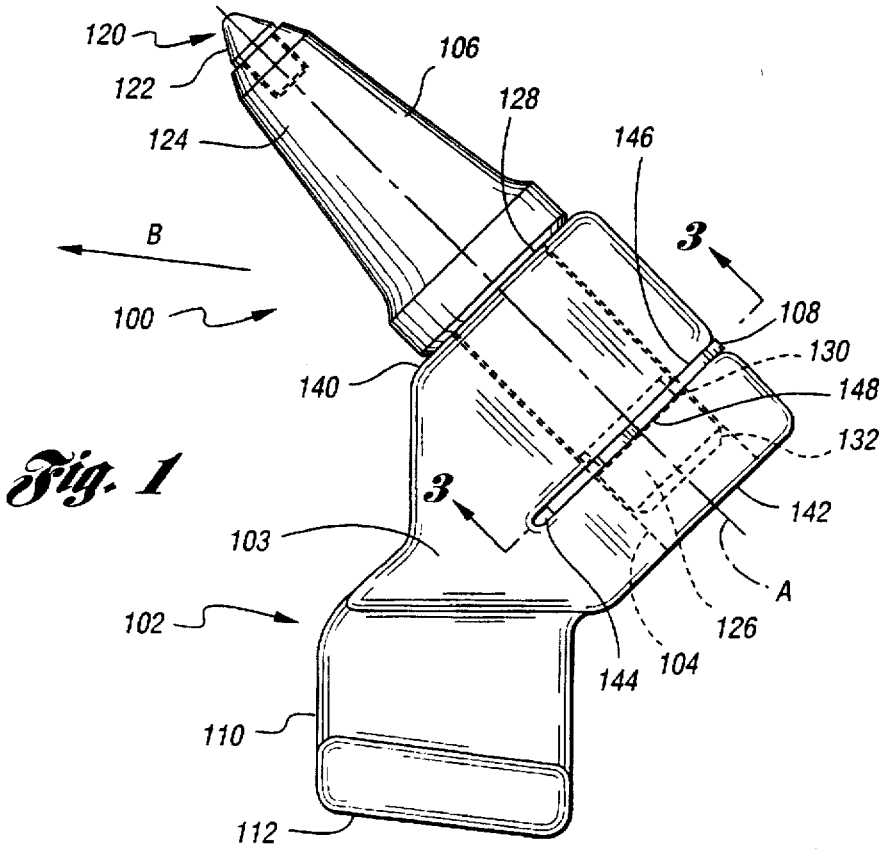
FIG. 1 is a side view of a support block, cutting tool, and clip, showing one embodiment of the invention.

One embodiment of the cutting tool retention system designated generally as 100 is shown in FIG. 1. The cutting tool retention system 100 includes a support block 102, the support block 102 having a support block body 103. The support block body 103 defines a block bore 104 into which a cutting tool 106 may be rotatably mounted via a clip 108. The support block body 103 has an exterior block surface 110 of which a portion is a block base 112. In use, such support blocks 102 can be distributed over, and the bases 112 may be welded or otherwise connected to, the circumference and length of a drum or other body (not shown) according to any desired pattern. The base 112 of the support block 102 may be radiused so as to match the radius of a drum or other body (not shown) in order to facilitate welding or otherwise connecting the base 112 of the support block 102 to a drum or other body (not shown). The drum may be driven by any conventional and suitable drive mechanism to cause the cutting tools 106 to engage and break up material that they are applied to. Such applications are well known in the art.

The cutting tool 106 having a longitudinal axis "A" typically has a cutting end 120 which generally comprises a hard cutting insert 122 typically mounted onto a generally conical outer region 124. This hard cutting insert 122 may be made from cemented tungsten carbide or any other suitable material. The hard cutting insert 122 is generally mounted at the end of the conical outer region 124 where it may be brazed or otherwise fastened into place.

The cutting tool 106 also typically includes a shank portion 126, in this case cylindrical, adjoining a tool shoulder 128 of the conical outer region 124. The shank portion 126 has a tool recess which may be an annular groove 130. The bottom end of the shank portion may also have a tool chamfer 132, preferably cut at an angle of approximately 45° to the longitudinal axis "A" of the cutting tool 106. Such cutting tools are generally known in the art and will not be described in further detail here.

The block bore 104 of the support block 102 is typically surrounded by a seating shoulder region 140. The shank portion 126 of the cutting tool 106 is typically inserted into the block bore 104 of the support block 102 such that the shoulder 128 of the cutting tool 106 may seat and bear upon the seating shoulder region 140 of the support block 102. The block bore 104, and accordingly the cutting tool 106, is pitched in the direction of travel of the cutting tool 106, shown as direction "B" in FIG. 1.

Figure 3:
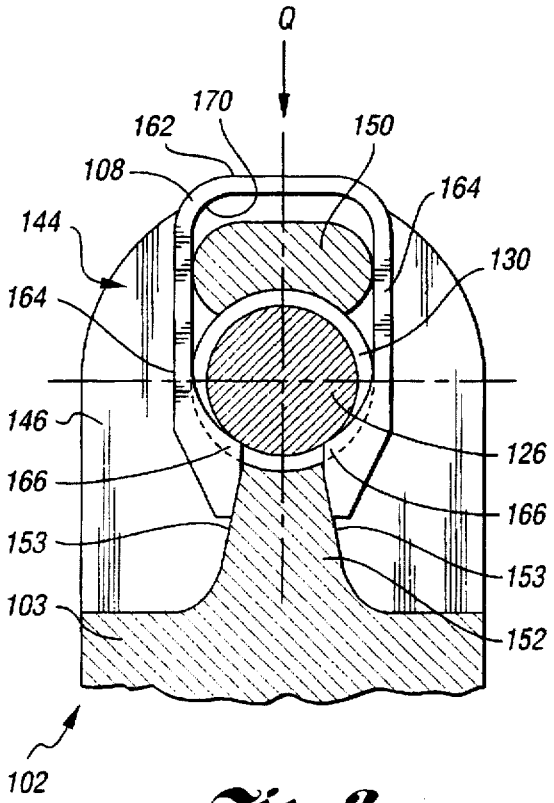
FIG. 3 is a cross-sectional view taken along line 3—3 of FIG. 1, showing the clip of one embodiment in an engaged position.
Figure 4:
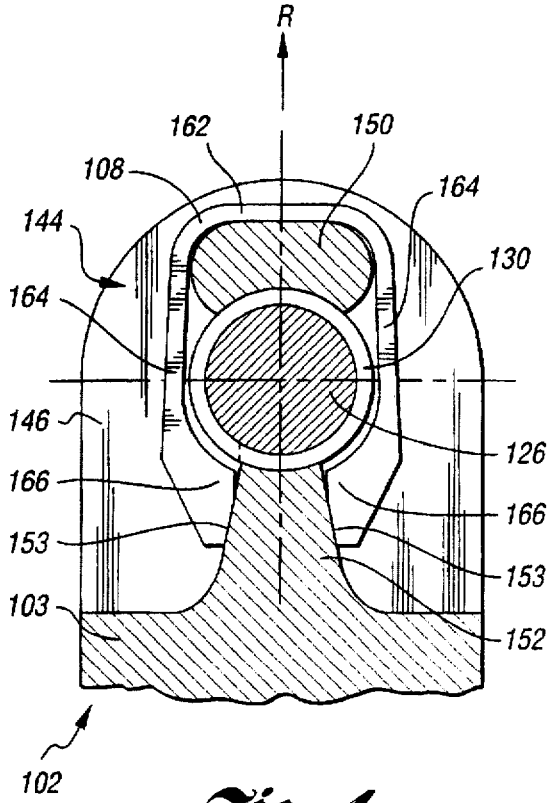
FIG. 4 is a cross-sectional view, similar to FIG. 3; showing the clip of one embodiment in a disengaged position.
Figure 5:
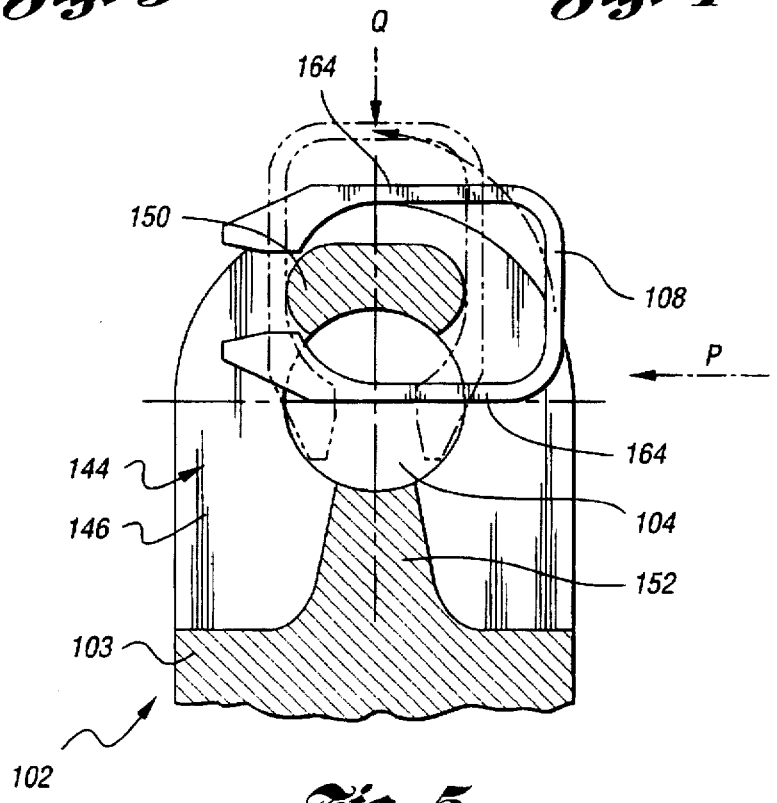
FIG. 5 is a cross-sectional view, similar to FIG. 3, showing how the clip is inserted into position.

As shown in FIG. 1, the support block 102 also has a rear block surface 142. As best shown in FIGS. 1, 3, 4, and 5, a block recess 144 is formed near the rear block surface 142. The block recess 144 defines a front recess surface 146 and a rear recess surface 148. As shown in FIGS. 3, 4, and 5, the block recess 144 defines a clip saddle 150 which, in this embodiment, bridges between the front recess surface 146 and the rear recess surface 148. In this embodiment, the clip saddle has an oblong shape, a racetrack-like perimeter configuration, partially intersected by the block bore 104.

The block recess 144 also ends at and defines a clip spreader 152 having tapered sides 153. The clip spreader 152 may be intersected, as shown in FIG. 5, by the block bore 104. The block recess 144, may be forged complete, forged to near net dimensions and finished via end milling, or produced totally by end milling. Any appropriate material could be used, such as grade 4140 steel having a Rockwell "C" hardness of 51–56.

Figure 2:
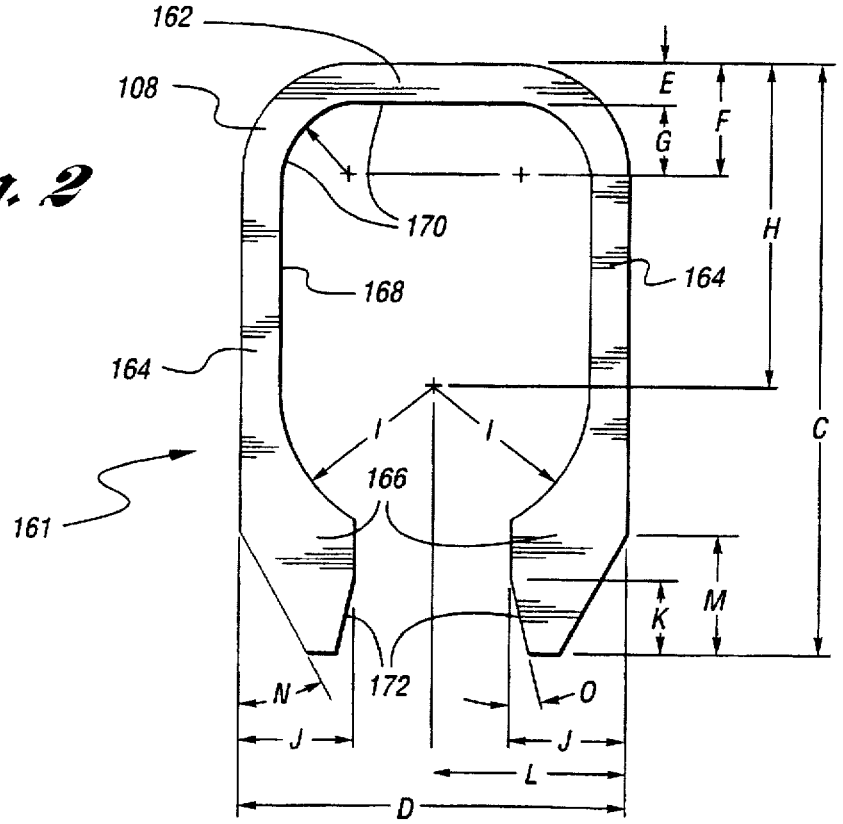
FIG. 2 is a plan view of a clip which may be used in one embodiment of this invention.

As shown in FIG. 2, the clip 108 of this embodiment has a spring structure 161. The clip 108 as shown is approximately rectangular in configuration, having a clip operator end 162 from which extend two clip legs 164. In this embodiment, the spring structure 161 constitutes the two clip legs 164 as will be explained. At the outermost ends, each clip leg 164 defines an inwardly projecting clip retainer projection 166. As shown in FIGS. 2 and 4, the inner perimeter 168 of the clip 108 defines a clip seat 170 at the clip operating end 162 which is preferably configured so that it may substantially mate with the clip saddle 150. As shown in FIGS. 2 and 3, the dimension between the two clip legs 164, twice the distance designated I, is approximately equal to, or slightly greater than, the length of the clip saddle 150 and the diameter of the cutting tool shank portion 126.

The clip retainer projections 166 have projection chamfers 172 which, as shown in FIGS. 3 and 4, are designed to mate with the clip spreader 152.

As shown in FIG. 2, and when using steel or aluminum sheet material, preferably approximately 0.1" to 0.15" thick, a clip having the following dimensions is believed to be suitable.

| | |
|---|---|
| C | 1.98" |
| D | 1.25" |
| E | 0.125" |
| F | 0.375" |
| G | 0.25" |
| H | 1.13" |
| I | 0.50" |
| J | 0.38" |
| K | 0.25" |
| L | 0.625" |
| M | 0.38" |
| N | 30° (optional) |
| O | 15° |

The clip 108 can be formed from any appropriate material. As shown in this embodiment, the clip 108 shown may be formed from sheet metal, preferably steel, such as grade 4140, or aluminum. Such clips 108 can be manufactured by a metal stamp method of manufacture. Alternatively, such clips may also be made from any appropriate wire material, such as formed wire. While not shown, such a wire clip would have a configuration similar to the sheet metal clip shown. Such a wire clip could likewise be formed from steel, such as grade 4140, heat treated to a Rockwell "C" hardness of 40–45.

As best illustrated by looking at FIGS. 3, 4, and 5, the cutting tool retention system 100 is assembled in the following manner. First, before the shank portion 126 of the cutting tool 106 is inserted into the block bore 104, the clip 108 must be placed within the block recess 144 around the clip saddle 150 in the position shown in FIG. 3 such that the clip legs 164 flank both the clip saddle 150 and the block bore 104 and the clip retainer projections 166 of the clip legs 164 flank the clip spreader 152.

As shown in FIG. 5, this is accomplished by first inserting the clip 108 in the direction "P" which is parallel to the longitudinal axis of the clip saddle 150. By inserting the clip 108 in this manner, the clip legs 164 need not be displaced relative to each other in order to fit around the clip saddle 150. The clip 108 is then rotated 90° as shown in FIG. 5. The clip 108 is then moved in the direction "Q" such that the clip 108 is in the position shown in FIG. 3, sans the cutting tool shank portion 126. The clip legs 164 will now flank the clip saddle 150 and the block bore 104, and the clip retainer projections 166 of the clip legs 164 will flank the clip spreader 152.

The clip 108 may now be operably moved. This is done by applying a force to the clip operator end 162, such as by pushing in the direction "Q" as shown in FIG. 3, until the clip seat 170 contacts the clip saddle 150 such that the clip retainer projections 166 no longer protrude into the block bore 104. At the same time, the projection chamfers 172 of the clip retainer projections 166 will engage the tapered sides 153 of the clip spreader 152 and force the clip legs 164 apart as shown in FIG. 4. As a result, the spring structure 161 is activated. The shank portion 126 of the cutting tool 106 may then be inserted into the block bore 104 until the annular groove 130 of the cutting tool 106 is exposed within the block recess 144. The clip operator end 162 of the clip 108 may then be released.

Upon release, the projection chamfers 172 of the clip 108 will slidably engage the tapered sides 153 of the clip spreader 152 of the support block 102 thereby forcing the clip 108 in the direction "R" as shown in FIG. 4 such that the clip legs 164 will return to a non-displaced configuration as shown in FIG. 3. As shown in FIG. 3, the clip retainer projections 166 of the clip legs 164 will then engage the annular groove 130 of the cutting tool 106 thereby rotatably retaining the cutting tool 106 in position. An annular groove 130 having a width of preferably 0.1" greater than the thickness of the clip 108 material has been found to be suitable. After the cutting tool 106 has been inserted in the block bore 104, the clip retainer projections 166 will not only flank the clip spreader 152, the clip retainer projections 166 will preferably be in close proximity to, or in a continually contacting and slidingly engaging relation with, the clip spreader 152.

In order to remove the cutting tool 106, the procedure just outlined is reversed. An operator simply pushes against a clip operator end 162 of the clip 108 in the direction "Q" as shown in FIG. 3 such that the clip retainer projections 166 no longer engage the annular groove 130 of the cutting tool 106 as shown in FIG. 4, thereby allowing easy removal of the cutting tool 106. At the same time, the clip legs 164 are displaced via the projection chamfers 172 engaging the clip spreader 152 such that the clip 108 will spring back into the position shown in FIG. 3 when released.

An advantage of this invention is that because the clip 108 is reusable, no other resilient keeper members or other types of clips need be supplied with the cutting tools 106. Furthermore, because the amount of transverse opening displacement required between the clip legs 164 for operation is minimal, any resultant deformation stresses are also minimal. Another advantage to this invention is that if the clip 108 is damaged or suffers excessive wear, it can be easily replaced by an operator on site without any tools.

All patents and patent applications cited herein are hereby incorporated by reference in their entirety.

While particular embodiments of the invention have been illustrated and described, it will be obvious to those skilled in the art that various changes and modifications may be made without departing from this invention. It is intended that the following claims cover all such modifications and all equivalents that fall within the spirit of this invention.

For example, the spring structure 161 in this embodiment constitutes the two clip legs 164 which are slidably displaced by the clip spreader 152, therefor biasing the clip back into an engaging relationship with the annular groove 130 of a cutting tool 106 inserted into the block bore 104 of the support block 102. However, the spring structure 161 could alternatively comprise any type of spring or resilient material which could be compressed or otherwise activated to bias a clip into an engaging relationship with the tool recess of a cutting tool inserted within the block bore of the support block. Accordingly, any reference to the clip having a spring structure or any such similar language encompasses any clip having any spring structure, such as a spring or resilient material, whether or not that spring structure is separate from, not connected to, or an integral part of, the remainder of the clip.

Furthermore, while this invention has been shown for use with a rotatable cutting tool 106 having a recess which is an annular groove 130, the tool recess may have any configuration such that the cutting tool 106 may be rotatable or non-rotatable.

What is claimed is:

1. The cutting tool retention system for retaining a cutting tool having a tool recess, the cutting tool retention system comprising:

a support block having a block bore and a block recess intersecting the block bore; and a clip movably situated in the block recess, the clip having a spring structure which engages the support block and urges the clip into an engaging relationship with the tool recess of the cutting tool situated within the block bore, the spring structure allowing the clip to be disengaged from an engaging relationship with the tool recess of the cutting tool situated within the block bore by applying a force directly to the clip so as to overcome the urging of the spring structure.

2. The cutting tool retention system for retaining a cutting tool having a tool recess, the cutting tool retention system comprising:

a support block having a block bore and a block recess intersecting the block bore, the block recess defining a clip spreader; and a clip in the block recess, the clip having a clip leg, the clip leg being displaced by the clip spreader when the clip is operably moved such that the clip leg will not engage the tool recess of the cutting tool situated within the block bore, the clip leg engaging the tool recess when the clip is not operably moved.

3. The cutting tool retention system of claim 2 wherein the clip leg has a clip retainer projection which engages the tool recess when the cutting tool is situated within the block bore and the clip is not operably moved.

4. The cutting tool retention system of claim 3 wherein the clip retainer projection prevents the clip from being removed from the block recess when the cutting tool is situated within the block bore.

5. The cutting tool retention system of claim 2 wherein the clip spreader has a tapered side and the clip leg is displaced by slidingly engaging the tapered side of the clip spreader when the clip is operably moved and the clip leg returns to a non-displaced position while slidingly engaging the tapered side of the clip spreader when the clip is not operably moved.

6. The cutting tool retention system of claim 2 wherein the clip has a clip operator end and two clip legs extending from the clip operator end, the two clip legs flanking the block bore and the clip spreader.

7. The cutting tool retention system of claim 6 wherein the clip legs have clip retainer projections which engage the tool recess when the clip is not operably moved but which do not engage the tool recess when the clip is operably moved.

8. The cutting tool retention system of claim 2 wherein the block recess has a clip saddle which limits the distance the clip can be operably moved.

9. The cutting tool retention system of claim 8 wherein the clip has an operator end and two clip legs extending from the operator end, the clip legs flanking the clip saddle, the block bore, and the clip spreader.

10. The cutting tool retention system of claim 9 wherein the clip spreader has tapered sides and the clip legs are displaced by slidingly engaging the tapered sides of the clip spreader when the clip is operably moved and the clip legs return to a non-displaced position while slidingly engaging the tapered sides of the clip spreader when the clip is not operably moved.

11. The cutting tool retention system of claim 9 wherein the clip legs having clip retainer projections which engage the tool recess when the tool is not operably moved but which do not engage the tool recess when the clip is operably moved.

12. A cutting tool retention system for retaining a cutting tool having a tool recess, the cutting tool retention system comprising:

a support block having a block bore and a block recess intersecting the block bore, the block recess defining a clip saddle; and a clip residing within the block recess and capable of being moved to engage or disengage the tool recess of the cutting tool inserted in the block bore, the clip having an operator end and clip legs extending from the clip operator end, the clip legs having retainer projections, the clip operator end, the clip legs and retainer projections partially encircling the clip saddle and the block bore so as to prevent the clip from being dislodged from residing within the block recess when the cutting tool is situated within the block bore.

13. The cutting tool retention system of claim 12 wherein the block recess defines a clip spreader and the clip legs flank the clip spreader such that the clip cannot be removed from the block recess unless the cutting tool is not situated within the block bore and the clip is moved such that the clip legs no longer flank the spreader and the clip is then rotated and removed from the block recess such that the clip legs no longer flank the clip saddle.

14. A clip for use with a cutting tool having a tool recess and a support block having a block bore and a block recess intersecting the block bore, the block recess having a clip saddle and a clip spreader, the clip comprising:

a clip operator end; and a clip leg extending from the clip operator end which is displaced by the clip spreader when the clip is operably moved such that the clip leg will not engage the tool recess of the cutting tool situated within the block bore, the clip leg engaging the tool recess of the cutting tool situated within the block bore when the clip is not operably moved.

15. The clip of claim 14 wherein the clip has at least two clip legs extending from the clip operator end which flank the clip saddle, the block bore, and the clip spreader when the clip is inserted into an operable position within the block recess.

16. The clip of claim 15 wherein the clip legs have retainer projections which engage the tool recess when the cutting tool is situated within the block bore and the clip is not operably moved, such that the clip cannot be removed from the block recess.

17. The clip of claim 16 wherein the clip cannot be removed from the block recess unless the cutting tool is not situated within the block bore and the clip is moved such that the clip legs no longer flank the clip spreader and the clip is then rotated and removed from the block recess such that the clip legs no longer flank the clip saddle.

18. A support block for use with a cutting tool having a tool recess and a clip having a clip operator end and clip legs extending from the clip operator end, the support block comprising:

a support block body having a block bore and a block recess intersecting the block bore, the block recess having a clip saddle and clip spreader which are flanked by the clip legs of the clip when the clip is operably inserted into the block recess such that the clip legs are displaced by the clip spreader when the clip is operably moved such that the clip legs will not engage the tool recess of the cutting tool situated within the block bore and the clip legs will engage the tool recess of the cutting tool situated within the block bore when the clip is not operably moved.

19. A method for retaining a cutting tool having a tool recess in a support block having a block bore and block recess by using a clip and a spring structure, the method comprising:

situating the clip in a block recess such that the clip protrudes into the block bore;

applying force to the clip such that the clip no longer protrudes into the block bore and the spring structure is activated;

inserting the cutting tool within the block bore such that the tool recess is located adjacent the block recess; and releasing the clip such that the spring structure forces the clip to protrude into the block bore and into an engaging relationship with the tool recess.

20. A method for retaining a cutting tool having a tool recess in a support block having a block bore and a block recess intersecting the block bore, the method comprising:

movably situating a clip having a spring structure in the block recess such that the clip will be urged by the spring structure to protrude into the block bore and engage the tool recess of the cutting tool inserted into the block bore unless a force is applied directly to the clip so as to overcome the urging of the spring structure.

21. A cutting tool retention system for retaining a cutting tool having a tool recess, the cutting tool retention system comprising:

a support block having a block bore and a block recess intersecting the block bore;

a clip movably situated in the block recess, the clip having a spring structure which engages the support block and urges the clip into an engaging relationship with the tool recess of the cutting tool situated within the block bore, the spring structure allowing the clip to be disengaged from an engaging relationship with the tool recess of the cutting tool situated within the block bore by applying a force directly to the clip so as to overcome the urging of the spring structure; and wherein the block recess of the support block has a clip spreader and the spring structure has a clip leg which engages the clip spreader and urges the clip into the engaging relationship with the tool recess of the cutting tool situated within the block bore, the clip leg allowing the clip to be disengaged from the engaging relationship with the tool recess of the cutting tool situated within the block bore by a user applying force directly to and moving the clip such that the clip leg is displaced and no longer engages the tool recess of the cutting tool.

22. The cutting tool retention system of claim 21 wherein the clip leg has a clip retainer projection which is urged by the clip spreader into an engaging relationship with the tool recess of the cutting tool situated within the block bore.

23. The cutting tool retention system of claim 21 wherein the clip leg has a clip retainer projection which prevents the clip from being removed from the block recess unless the cutting tool is no longer positioned in the block bore so as to be situated within the block recess.

24. A cutting tool retention system for retaining a cutting tool having a tool recess, the cutting tool retention system comprising:

a support block having a block bore and a block recess intersecting the block bore;

a clip movably Situated in the block recess, the clip having a spring structure which engages the support block and urges the clip into an engaging relationship with the tool recess of the cutting tool situated within the block bore, the spring structure allowing the clip to be disengaged from an engaging relationship with the tool recess of the cutting tool situated within the block bore by applying a force directly to the clip so as to overcome the urging of the spring structure; and wherein the block recess has a clip saddle which limits movement of the clip when force is applied directly to the clip so as to overcome the urging of the spring structure.

25. The cutting tool retention system of claim 24 wherein the block recess has a clip spreader, the clip has a clip operator end and the spring structure is two clip legs extending from the clip operator end, the two clip legs flanking the clip saddle, the block bore, and the clip spreader, the clip legs being displaced by the clip spreader when force is applied directly to the clip so as to disengage the clip from the tool recess of the cutting tool situated within the block bore.

26. The cutting tool retention system of claim 25 wherein the clip legs have clip retainer projections which are urged by the clip spreader into an engaging relationship with the tool recess of the cutting tool situated within the block bore.

27. The cutting tool retention system of claim 25 wherein the clip legs have clip retainer projections which prevent the clip from being removed from the block recess unless the cutting tool is no longer positioned in the block bore so as to be situated within the block recess.

* * * * *